United States Patent [19]

Seifert

[11] 4,080,130

[45] Mar. 21, 1978

[54] APPARATUS FOR EXTRUDING, LINING AND PRESSING CLAY BLANKS

[75] Inventor: Helmut Seifert, Kuils River, South Africa

[73] Assignee: Continental China (Pty.) Limited, Blackheath, South Africa

[21] Appl. No.: 638,313

[22] Filed: Dec. 8, 1975

[30] Foreign Application Priority Data

Jan. 8, 1975 South Africa ..... 75/0141

[51] Int. Cl.[2] ..... B28B 3/20; B28B 11/10

[52] U.S. Cl. ..... 425/89; 425/299; 425/305.1; 425/308; 425/327; 425/395

[58] Field of Search ..... 425/89, 305, 327, 395, 425/397, 408, 299, 308; 264/210, 294

[56] References Cited

U.S. PATENT DOCUMENTS

| | | | |
|---|---|---|---|
| 2,952,877 | 9/1960 | Park, Jr. | 264/210 R |
| 3,462,810 | 8/1969 | Matsushima | 425/305 |
| 3,540,093 | 11/1970 | Boatright, Jr. et al. | 425/305 |
| 3,585,678 | 6/1971 | Neumann et al. | 425/89 |
| 3,667,971 | 6/1972 | Brunner | 425/305 |

*Primary Examiner*—Francis S. Husar
*Assistant Examiner*—John McQuade
*Attorney, Agent, or Firm*—Fred Wiviott

[57] ABSTRACT

In a process and a machine for moulding ceramic articles, the provision of a substantially moisture impervious foil between the mould surfaces and the clay blank and the disposal of the foil after its use as a waste by-product. A foil exhibiting predominant plasticity rather than elasticity is selected to secure effective operation of the invention. The clay blank is extruded in strand form at a rate of extrusion which is independent of the rate of feeding clay blanks intermittently into the mould and a temporary storage station provides buffer capacity between the extrusion and moulding steps. The machine has structure adapted to achieve this operation.

2 Claims, 9 Drawing Figures

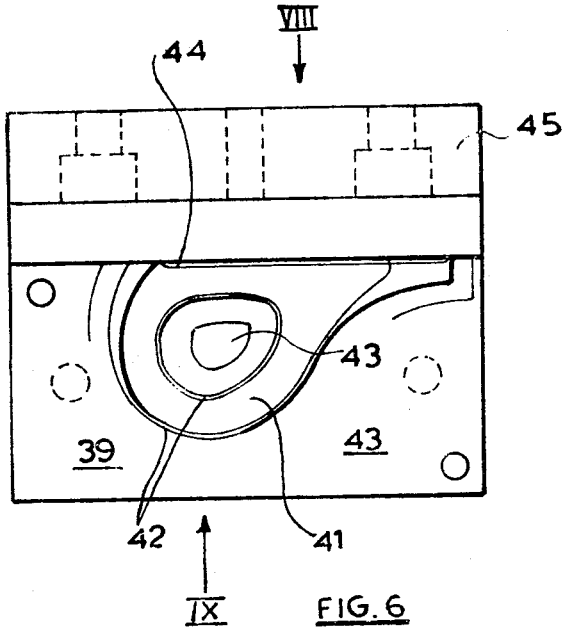
FIG. 6
FIG 7
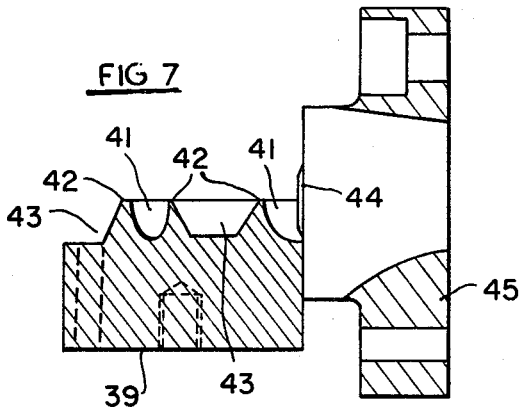

APPARATUS FOR EXTRUDING, LINING AND PRESSING CLAY BLANKS

BACKGROUND OF THE INVENTION

The present invention relates to the moulding of ceramics articles by introducing into a mould cavity of a pressing mould defined by at least two relatively movable mould sections a body of ceramics clay, closing the mould by moving the mould sections under pressure to positions corresponding to the outlines to be moulded, opening the mould and removing the now moulded body of clay and passing the moulded body to further processing.

Various modifications of such procedures are known and applied in ceramics manufacture. In the manufacture of crockery for example, cups are usually manufactured e.g. by the modification known as "jigger moulding" in which the body of clay is first pre-shaped in the mould prior to the closing of the mould and final pressing of the articles.

In conventional moulding procedures, the dies of the mould are heated to a high temperature to facilitate the release of the clay from the mould due to the formation of steam. The need for such heating is a disadvantage for which reason smaller articles, e.g. the handles of cups and similar articles of crockery, have been manufactured in the past by different methods, e.g. slipcasting.

Because the shrinkage of handles so produced is different from that of the cup or the like produced by pressure moulding, there is a considerable tendency for these handles to come loose in subsequent manufacture. Conventionally produced handles furthermore require (usually manual) shaping and trimming of the contact faces by which the handles are joined to the cup or other item of crockery.

In slip-casting a slip of clay is cast into a plaster of Paris mould. The porous plaster of Paris absorbs water from the slip. The moulded article, because of its loss of water to the mould shrinks and is thereby readily released by the mould. With this in mind, attempts were made to apply this principle to a wet pressing method, by inserting a layer of an absorbent, i.e. moisture pervious material such as blotting paper between the clay and the surface of the pressing die (the latter being made of metal). These attempts were not satisfactory.

Disclosed is a process which in the appropriate circumstances facilitates the manufacture of ceramics articles. In particular the process is adaptable to the manufacture of comparatively small articles such as the handles of cups and similar items of crockery. The process is adaptable to largescale manufacture and can be adapted to eliminate also the inconvenient prior step of shaping and trimming the contact faces of crockery handles. In addition there is provided an apparatus for carrying out the process.

SUMMARY OF THE INVENTION

Disclosed is a process as outlined in the opening paragraph which comprises providing a clay blank from which an article or articles is/are to be moulded, introducing the clay blank into a mould cavity with a layer of substantially moisture impervious foil between the mould surfaces and the clay, the foil being readily releasable from the clay and sufficiently flexible to assume the moulded shape, moulding the article or articles in the clay blank and foil, transporting the articles away from the mould, removing the foil and disposing of the foil as a waste by-product.

Preferably the foil is a plastics foil, e.g. a polyethylene foil. A reasonable tear strength and a degree of elasticity and plasticity of the foil is advantageous. Other plastics foils which could be used are polypropylene foils, polyvinylchloride foils, polyacetal foils. If desired the foils may be elastomeric, although in practice this is usually not necessary.

Preferably the foil exhibits properties when flexed which are predominantly plastic rather than elastic. With these properties the foil will remain substantially in the moulded shape, adhering to the moulded clay surfaces, after the moulding step. Thus the foil is characterised by a tendency for retention of any flexion imposed upon it to predominate over a tendency for elastic return to unflexed condition.

In the preferred process the volume of clay introduced into the mould is larger than the volume of the final article, provision being made in the mould for the escape of excess material away from the article being moulded.

In accordance with particular convenient embodiments of the invention the clay blank is brought together with the foil and wrapped into the foil prior to its introduction into the mould cavity. In a particularly advantageous embodiment the foil is employed in continuous, elongate ribbon form, entering the mould from one side and, after the pressing step, leaving the mould from the other side and finally being fed into disposal means, e.g. a bin.

A distinctive feature of the preferred embodiment of this invention is the provision of the foil in a single, continuous elongate ribbon, folding this ribbon to wrap the blank(s) and feeding the ribbon with blanks into the mould, withdrawing same after moulding, separating the moulded blanks from the foil and then discarding the foil. There is preferably only a simple enfolding of the ribbon into the form of a continuous channel.

Also preferably, the clay blank is fed to the mould cavity in the form of an elongate strand, preferably wrapped into a single ribbon of foil.

From the aforegoing it follows that the foil preferably acts as a release agent as well as a transport medium for the clay.

Preferably the strand is extruded with an extrusion rate which is independent of the rate of feeding into the mould cavity with provision for buffer capacity between the step of strand extrusion and the pressing step. Plurality of articles may be moulded from the elongate blank in successive steps, moving the blank and foil intermittently.

Clay in the sense of the present specification, is intended to include any clay-like pressure-mouldable wet material used in the manufacture of ceramics, including ordinary pottery clay, porcelain clay and stoneware clay.

In the manufacture of handles for crockery the contact faces by which the handles are to be applied to the articles of crockery, are preferably moulded directly with the required contours complementary to the contours of the locality of application of the item of crockery.

Also, in accordance with the present invention there is provided a moulding press for moulding ceramics clay, comprising a mould cavity defined by at least two relatively movable mould sections combined with means adapted for feeding a foil into the mould in such a manner as to form a liner of the mould cavity, the means being adapted to thus feed a foil which is substantially moisture impervious, readily releasable from the clay and sufficiently flexible to assume the moulded shape, and means adapted to permit disposal of the foil after removal of the foil from the moulded articles, and means for feeding clay blanks to the mould cavity.

Preferably there is provided a reel for a continuous ribbon of said foil and appropriate guide means for the ribbon.

The guide means preferably include a means adapted for guiding the ribbon towards the mould enfolded into the form of a continuous channel.

Also, the apparatus preferably comprises means for feeding a strand of clay intermittently towards and into the mould. In the embodiment in which the ribbon is guided in the form of a channel, the said means for feeding the strand of clay is adapted for feeding said strand into the channel.

The preferred apparatus also comprises a conveyor on the side of the moulding press opposite to the side from which the ribbon and clay are introduced, for moving moulded bodies, foil withdrawn from the mould and waste clay away from the press, and for disposal of the used foil.

A further characteristic of the process in accordance with the preferred embodiment of this invention is that there is a mechanical production of blanks, a manual transfer of blank from buffer station to start of moulding train, mechanical transport of blank through moulding train and enfolding of blank in foil, manual unwrapping of foil and storing of moulded articles.

According to a further aspect of the present invention there is provided an apparatus comprising a combination of a clay extruder and a moulding press with means for feeding extruded clay blanks to the moulding press and comprising a buffer storage device for extruded clay blanks, the means for feeding clay blanks being adapted to be fed with blanks from the buffer storage device with an operating cycle independent of the operating cycle of the extruder.

The aspect of the invention just defined, is preferably combined with the apparatus features described further above.

The clay extruder preferably comprises an extruder cylinder terminating in an extruder nozzle, the end of the extruder cylinder opposite the nozzle being hinged to a backing flange through which passes the piston rod of the displacement piston for forcing clay in the extrusion cylinder towards the nozzle, the hinging being adapted for swinging the cylinder open, preferably side-ways, for the charging of clay into the cylinder.

The apparatus may be combined with a press, preferably a vacuum press, e.g. of conventional design for moulding blocks of clay, preferably de-aerated under vacuum, which are fed into the extrusion cylinder. However, preferably such blocks of clay are moulded in a separate machine not forming part of the present apparatus.

Further preferred features of preferred embodiments will become apparent from the following description with reference to the drawings.

BRIEF DESCRIPTION OF THE DRAWINGS

In the drawings:

FIG. 2 represents an end elevation of a collecting and storing (buffer) device, for extruded clay strands produced by the extruder device in the machine in accordance with FIG. 1;

FIG. 6 represents a plan view of the lower mould section and of the backplate of a pressing mould of the machine in accordance with FIG. 1;

FIG. 7 represents a vertical section of the means shown in FIG. 6;

DESCRIPTION OF THE PREFERRED EMBODIMENTS

Figure 1:
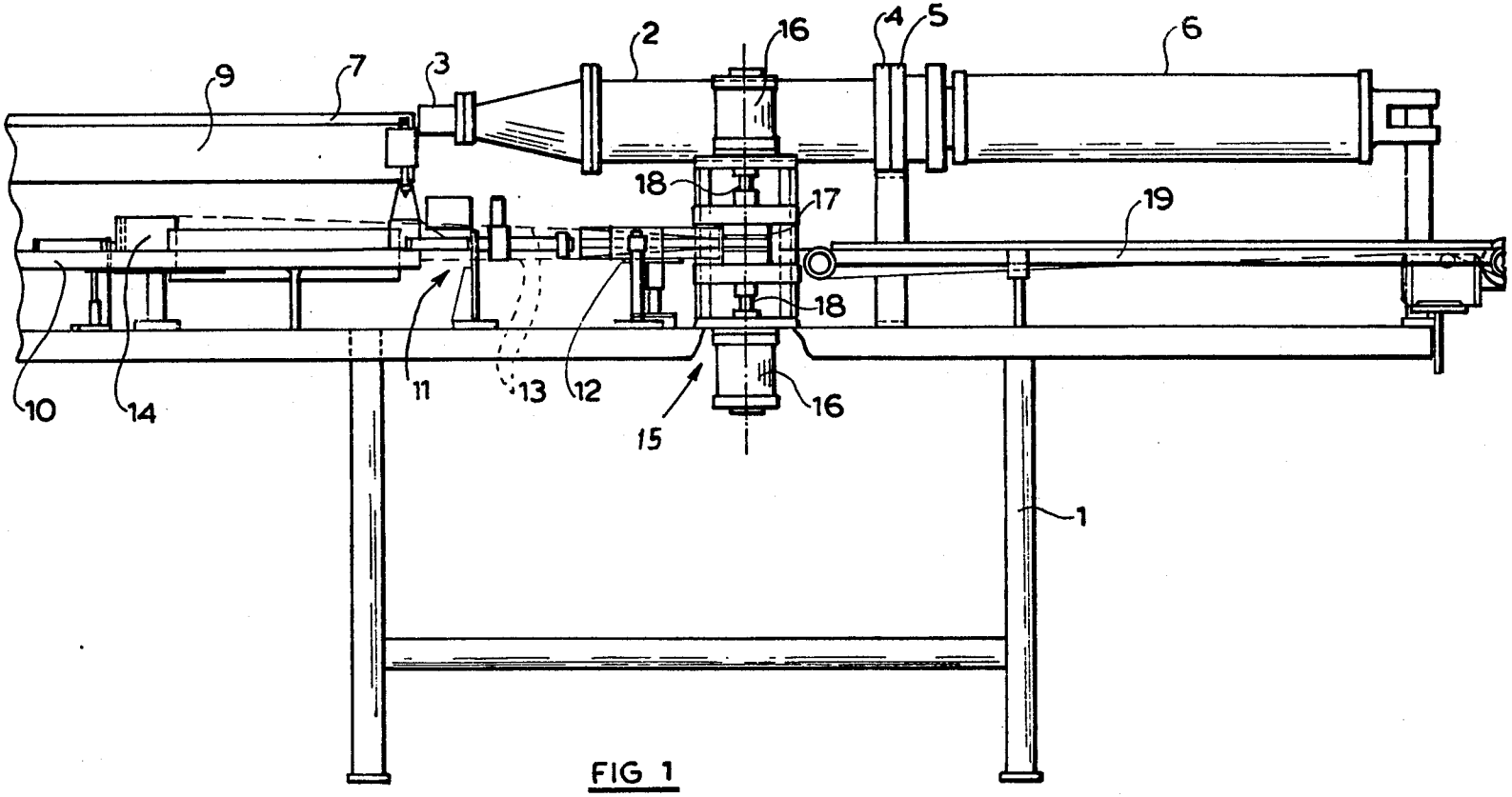
FIG. 1 represents an elevation of a machine in accordance with the invention.

Referring now to FIG. 1 of the drawings, the machine there illustrated comprises a stand 1 on which the remaining parts including the moulding press 16, 17, 18, clay blank extruder 2, 3, 4, 5, 6, a buffer storage platform 7, 9, guiding structure for foil and clay blanks 12, clay blank feeding mechanism 11 and a path for mould clay products and foil which is to be disposed of 19, of the machine are mounted. These include an extrusion cyclinder 2 provided at one end with an extrusion nozzle 3, the opposite end of the cylinder at flange 4, on that side which is opposite to the side visible in the drawing, being hinged to a backing flange 5 through which passes the piston rod of the displacement piston for forcing clay in the extrusion cylinder towards the nozzle. This piston rod is driven by a piston of the hydraulic piston cylinder device 6. The hinging at 4 permits the cylinder to be swung open sideways for the purpose of being charged with a premoulded, closely fitting, cylindrical block of clay (not shown). The block of clay is preferably moulded by a vacuum pressing device not forming part of the present apparatus.

The piston-cylinder device 6 is actuated to extrude clay through nozzle 3 in the form of a strand of suitably selected cross section, which strand is deposited on the collecting chute 7 (see also FIG. 2) of a collecting and storing (buffer) device for the extruded clay. Appropriate lengths of clay strand deposited on collecting platform 7 are cut off manually and are stored (as indicated in dotted lines 8) on the inclined storage chute 9 of the device, (see FIG. 2). Such strands are then transferred manually as required to the feeder chute 10 which in the preferred embodiment takes the form of a roller conveyor chute by virtue of its surface being composed of a large number of plastics rollers (not shown) on which the clay strands can easily be moved in the direction of further travel, i.e. now in the right hand direction. This further travelling is brought about by a feeder device 11 to be described in greater detail further below, which is adapted to advance the strand of clay discontinuously, but in synchronisation with the operating cycle of subsequently following moulding means by predetermined distances during any stroke of the device 11. The strand then passes through a guide device 12 which will be described below with reference to FIG. 5. This guide device 12 simultaneously acts as a guide for a ribbon 13 of plastics foil fed from a reel 14 and which in the guide device 12 is formed into a channel embracing the strands of clay.

The next item of the machine is the moulding press 15, parts of which will be described in greater detail with reference to FIGS. 6 to 9.

The moulding press comprises two accurately balanced and synchronised pneumatic cylinders 16, provided respectively above and below the pressing mould 17, consisting of two mould sections in the form of metal dies movable towards one another by the jacks 18 driven by the pneumatic cylinders 16, the dies sliding on one side along a backplate as illustrated in FIGS. 6 to 9.

In the open position of the mould 17, the clay strand together with the plastic foil embracing it, is forwarded by a distance adapted to bring an adequate body of clay into register with the dies. The mould is then closed under pressure resulting in the moulded body being formed between layers of plastics foil, excess clay being squeezed out of the way into appropriate cavities provided for that purpose in the mould. The mould is then opened and the moulded article, excess clay and plastics foil all advance together from the mould on the conveyor belt 19, from where an operator picks up the moulded articles, and puts these on a tray for further processing. The excess clay may be recycled, whereas the plastics ribbon goes to waste.

Figure 3:
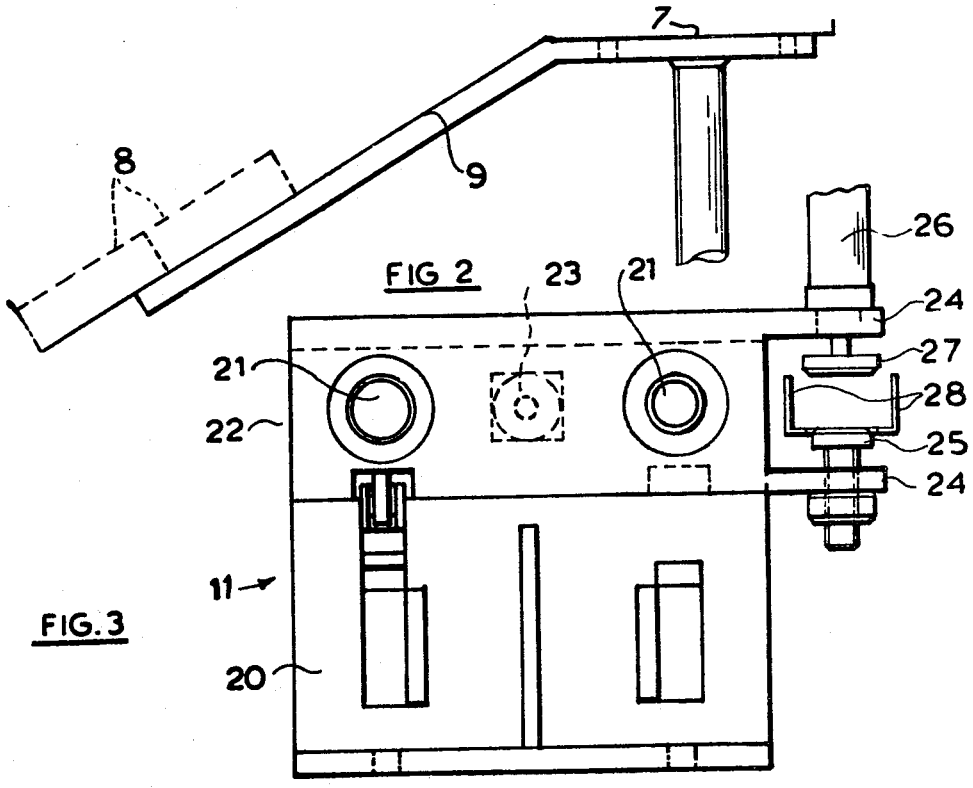
FIG. 3 represents an end elevation, viewed from right to left of FIG. 1 of the device for feeding clay strands towards the pressing mould of the machine in accordance with FIG. 1.
Figure 4:
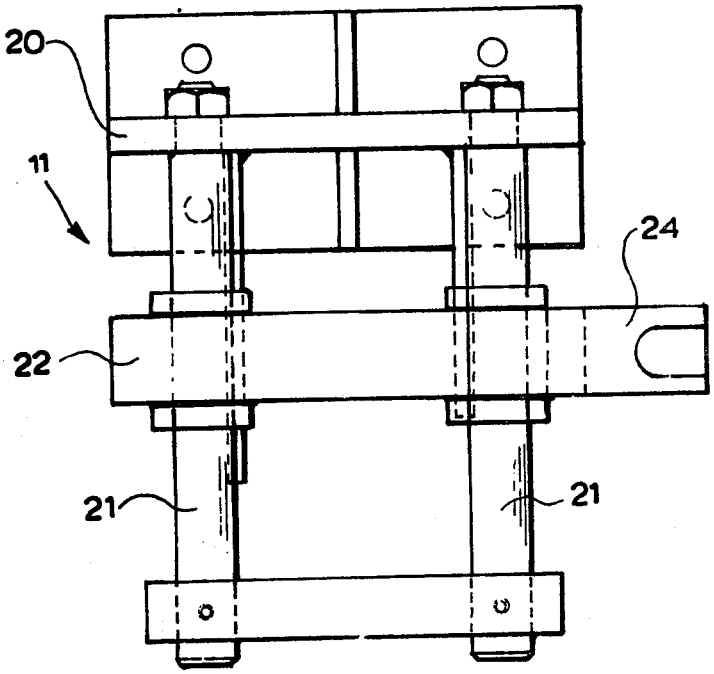
FIG. 4 represents a plan view of part of the means shown in FIG. 3.

Referring now particularly to FIGS. 3 and 4 of the drawings, the feeding device 11 is mounted on a bracket 20 from which project in the direction of feeding two parallel sliding rails 21 on which a carriage 22 is slidably mounted. The sliding movement of the carriage 22 on the sliding rails 21 is brought about by a pneumatic cylinder 23 (not shown in FIG. 4). The carriage 22, on one side thereof carries a pair of brackets 24. The lowermost of these brackets 24, as shown in FIG. 3, carries the adjustable lower jaw 25 of a gripping device, whereas the upper bracket carries a pneumatic cylinder 26 for actuating the upper jaw 27 of the gripping device. Separate from and passing between the brackets 24, parallel to and on either side of the path of travelling of the strand of clay, are guide baffles 28.

In operation, the carriage 22 at the end of each clay advancing cycle is returned to its starting position close to bracket 20, actuated by pneumatic cylinder 23. In order to advance the clay, the jaw 27 is moved downwards by the pneumatic cylinder 26 so as to grip the strand of clay between the jaws 25 and 27. The carriage is then moved forward by the pneumatic cylinder 23 by a predetermined distance corresponding to the stroke for each cycle, whereupon the pneumatic cylinder 26 is actuated to release the strand, and the carriage is returned to its starting position. This operation is synchronised with the action of the moulding press 15, 16, 17, 18. The clay advance takes place whilst the mould is open.

Figure 5:
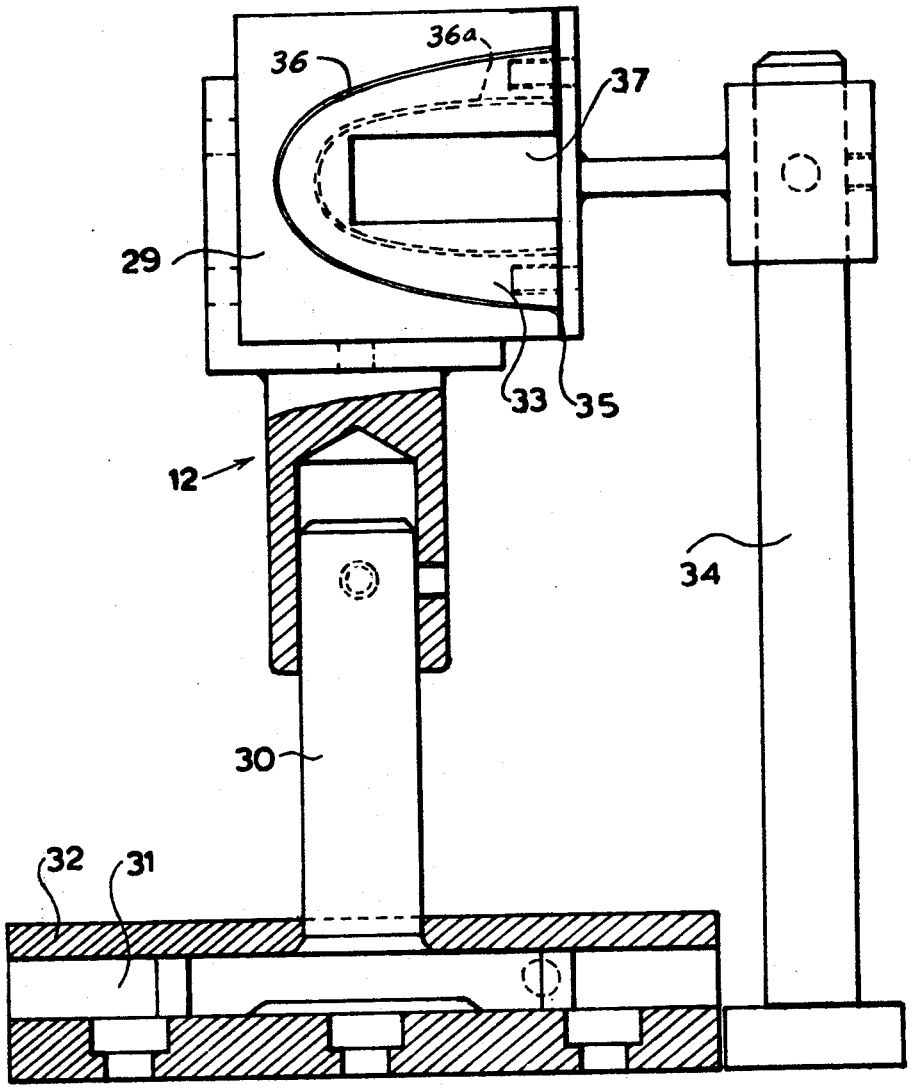
FIG. 5 represents an end elevation seen in the direction opposite to that of FIG. 3 of a guide device for plastics foil and for the extruded strand of clay.
Figure 8:
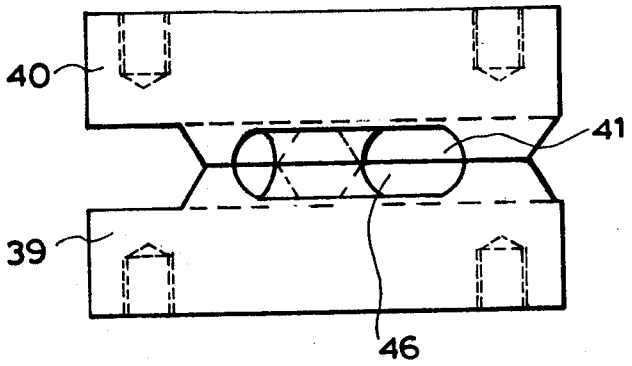
FIG. 8 represents an elevation of the closed mould taken in the direction of arrow VIII in FIG. 6 (the back plate having been removed) and FIG. 9 represents a front elevation of the back plate in FIG. 6 taken in the direction of arrow IX in FIG. 6.
Figure 9:
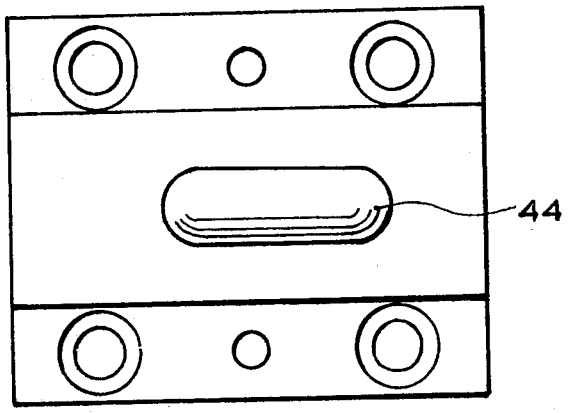

Referring now to FIG. 5 of the drawings, the guide device 12 comprises an outer guide member 29 mounted on a bracket 30 which in turn is slidably mounted in a passage 31 of a mounting base 32. An inner guide member 33 is mounted on a second bracket 34, stationarily mounted on the machine table. The inner guide member 33 has a convex shape which, save for a clearance 35, is complementary to a concave cavity 36 of the outer guide member 29. In the operating position of the two guide members, their contours combine to form a gap of parabolic outlines serving as a guide passage for the ribbon of plastic foil, thereby to deform the plastic foil into a continuous, U-shaped channel which (at its open end) is widest where the ribbon enters the guiding device (i.e. on the side facing the observer) and which is narrowest (dotted line 36*a*) on the opposite side where the plastic ribbon leaves the guide device. The inner guide device 33 is provided with a passage 37 of rectangular cross section for the guidance therethrough of the extruded clay strands which, on leaving the guide device is wrapped into the channel formed by the plastic foil.

In order to introduce the foil into the guide device, the bracket 30 is slidably moved to the left hand side in the base 32, whereby the outer guide member 29 is moved away from the inner guide member 33, thereby opening up the passage 36, 35 for the easy introduction of the plastic ribbon.

Referring now to FIGS. 6 to 9 of the drawings, the pressing mould consists of a lower mould section in the form of the metal die 39 and an upper mould section similarly in the form of a metal die 40. These dies are shaped to define the outlines of a mould cavity 41 by means of narrow ridges 42 outside which there are cavities 43 for the accommodation of excess clay left over after the moulding operation.

In the example shown the mould is designed for the moulding of handles for crockery such as cups. For that purpose, one side of the mould is defined by the machined surface 44 of stationary back plate 45. As shown more clearly in FIG. 7 and FIG. 9, the machined surface 44, in the region of an opening 46 left on one side between the dies 39, 40 has a convex curvature. This convex curvature corresponds to the convex curvature of the cup to which the handle is to be fitted. Accordingly, the moulded handle is given a contact face of a concave curvature complementary to the convex curvature of the cup and can thus be fitted to the cup directly without further shaping.

The plastic foil ensures a ready release of the moulded articles and contributes to a long life of the steel dies. Heating of the dies is no longer necessary. The plastic ribbon simultaneously serves to transport the clay and subsequently the moulded article through the machine. With this comparatively simple construction, throughputs of 60 pressing strokes per minute have been attained. A single operator can operate the machine, although two operators are to be employed if very high throughput capacities are aimed at.

In a manner known per se, the machine may be provided with safety switches, which automatically switch off the machine and let it return to its starting position in the event of operating faults. Also, in the preferred embodiment the moulding press 15 is provided with a cover (not illustrated) which, unless it is properly in position, will cause the automatic switching off of the machine.

I claim:

1. An apparatus for moulding ceramics clay articles which comprises a moulding press for moulding the clay articles from ceramics clay blanks, the moulding press comprising at least two mould parts movable with respect to each other from an opened position to a closed position in which they define a mould cavity, combined with a reel for a foil which is substantially moisture impervious, readily releasable from the clay and sufficiently flexible to assume the shape of the articles which the mould parts are adapted to mould, which reel is mounted to one side of the moulding press, guiding structure for the foil mounted between the reel and the moulding press, adapted to guide the foil into the moulding press wrapped around the clay blank in such a manner as to form a liner of the clay in the mould cavity, structure mounted on the opposite side of the moulding press to the reel and guiding structure and forming a conveyor for moulded clay articles and for disposal of the foil as a waste by-product after passage of the foil through the moulding press and its removal from the moulded articles, a mechanism for intermittently advancing clay blanks to the mould cavity together with the foil, the mechanism comprising a carriage mounted adjacent the reel and the guiding structure and adapted to be reciprocated towards and away from the moulding press, the carriage supporting a clamp adapted to alternately clamp and release the clay blank in synchronism with the reciprocation of the carriage so as to clamp the clay during movement of the carriage and clamp towards the moulding press and release the clay during movement away from the moulding press.

2. An apparatus for moulding ceramics clay articles which comprises a moulding press for moulding the clay articles from ceramics clay blanks, the moulding press comprising at least two mould parts movable with respect to each other from an opened position to a closed position in which they define a mould cavity, combined with a reel for a foil which is substantially moisture impervious, readily releasable from the clay and sufficiently flexible to assume the shape of the articles which the mould parts are adapted to mould, which reel is mounted to one side of the moulding press, guiding structure for the foil mounted between the reel and the moulding press, adapted to guide the foil into the moulding press wrapped around the clay blank in such a manner as to form a liner of the clay in the mould cavity, the guiding structure comprising an inner guide member having a convex shape and an outer, movable guide member having a concave shape which is complementary to the convex shape and normally has a clearance between the two shapes for passage of the foil, structure mounted on the opposite side of the moulding press to the reel, and guiding structure and forming a conveyor for moulded clay articles and for disposal of the foil as a waste by-product after passage of the foil through the moulding press and its removal from the moulded articles, a mechanism mounted adjacent the reel and the guiding structure for intermittently advancing clay blanks to the mould cavity together with the foil, a device adapted to provide clay blanks in elongated strands, and a buffer storage station, the device operatively associated with said buffer storage station to supply the clay blanks to the buffer station for temporary storage there, which buffer storage station comprises a collecting platform which leads onto an inclined storage chute adjacent said mechanism from which the clay blanks may be fed to the mechanism for advancing clay blanks to the mould cavity.

* * * * *